US007358932B2

(12) United States Patent
Chen et al.

(10) Patent No.: US 7,358,932 B2
(45) Date of Patent: Apr. 15, 2008

(54) DRIVING CIRCUIT OF A PLASMA DISPLAY PANEL

(75) Inventors: Bi-Hsien Chen, Ping-Tung Hsien (TW); Yi-Min Huang, Taipei (TW); Yung-Chan Chou, Tao-Yuan Hsien (TW); Yi-I Lu, Tao-Yuan Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 506 days.

(21) Appl. No.: 10/908,813

(22) Filed: May 26, 2005

(65) Prior Publication Data

US 2006/0267874 A1 Nov. 30, 2006

(51) Int. Cl.
*G09G 3/28* (2006.01)

(52) U.S. Cl. ..... 345/63; 345/66

(58) Field of Classification Search ..... 345/60, 345/63, 66, 204, 211, 212; 315/169.3, 169.4; 313/567

See application file for complete search history.

(56) References Cited

U.S. PATENT DOCUMENTS 4,866,349 A 9/1989 Weber et al.
5,081,400 A 1/1992 Weber et al.
5,642,018 A * 6/1997 Marcotte ..... 315/169.4
5,828,353 A 10/1998 Kishi et al.
6,175,192 B1 * 1/2001 Moon ..... 315/169.3
6,366,063 B1 * 4/2002 Sekii ..... 323/223
6,768,270 B2 * 7/2004 Chae ..... 315/169.3
6,897,834 B2 * 5/2005 McCormack ..... 345/55
7,075,239 B2 * 7/2006 Kang et al. ..... 315/169.3
7,109,951 B2 * 9/2006 Kim et al. ..... 345/63
7,166,967 B2 * 1/2007 Cho et al. ..... 315/169.3
7,271,782 B2 * 9/2007 Yoon et al. ..... 345/60
2004/0212316 A1 * 10/2004 Park ..... 315/169.4
2006/0066606 A1 * 3/2006 Yoo ..... 345/211
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A driving circuit of a plasma display panel utilizes only one energy recovery unit for both sides of the panel capacitor. The driving circuit includes a panel capacitor having an X-side and a Y-side, a voltage clamping circuit and an energy recovery unit. The voltage clamping circuit includes four switches and is provided in parallel with the panel capacitor of the plasma display panel. The energy recovery unit is coupled between the X-side of the panel capacitor and the Y-side of the panel capacitor for charging and discharging the panel capacitor.

23 Claims, 9 Drawing Sheets

DRIVING CIRCUIT OF A PLASMA DISPLAY PANEL

BACKGROUND OF INVENTION

1. Field of the Invention

The present invention relates to a driving circuit of a plasma display panel, and more particularly, to a driving circuit of a plasma display panel which uses one energy recovery unit for charging and discharging both sides of a panel capacitor.

2. Description of the Prior Art

In recent years, plasma display panels (PDP) have become more and more popular over the traditional cathode ray tube terminals (CRT) due to the advantages of thinner appearance and higher quality display. Generally speaking, under a given voltage, charges accumulated over electrodes in a PDP are released to produce discharge glow that can achieve different display effects. PDPs can be categorized into two types depending on driving method. The first type is an alternating current (AC) PDP operated by an AC discharge indirectly between electrodes coated with dielectric film. The second type is a direct current (DC) PDP operated by a DC discharge directly between electrodes exposed to a discharge space. The AC PDP has been regarded as mainstream because of lower power consumption and longer lifetime.

A customary surface-discharge AC type PDP is composed of a display panel and a driving circuit. The PDP includes a plurality of discharge units, each having paired electrodes, an X-electrode and a Y-electrode, and an address electrode. The driving circuit is for driving the three electrodes of each discharge unit respectively, in accordance with the driving method and the driving procedures. The typical operation of an AC plasma display involves applying alternating pulses to paired electrodes in order to initiate discharge glow. A voltage of up to about 200 V is typically required to be applied to the electrodes. In addition, a pulse-duration of several microseconds is usually adopted. Hence the power consumption of the PDP display is quite considerable. Energy recovery (power saving) is therefore sought. Many designs and patents have been developed for providing methods and apparatuses for energy recovery in PDPs. One of the examples is U.S. Pat. No. 4,866,349 "Power Efficient Sustain Drivers And Address Drivers for Plasma Display Panel" to Weber et al., which is included herein by reference.

FIG. 1 is a circuit diagram showing an example of a prior art PDP driving circuit 10. As shown, the driving circuit 10 comprises an X-side driving circuit section 11 and a Y-side driving circuit section 12 having the same structure as the X-side driving circuit section 11. The two driving circuit sections 11 and 12 are coupled to each other in series by a panel capacitor 14. Here, the construction and operation of only the X-side driving circuit section 11 will be described.

In the X-side driving circuit section 11, an inductor 16 is connected to an X-side of the panel capacitor 14 (In the Y-side driving circuit section 12, the inductor 16 is connected to a Y-side of the panel capacitor 14). Four field-effect transistor (FET) switches 21, 22, 23 and 24 are connected to the ends of the inductor 16. A recovery capacitor 29 is connected commonly to one end of each of the two FET switches 21 and 22 and serves as a variable voltage source, which varies according to the value of Vs, for the driving circuit 10. Designated as D are diodes.

In the X-side driving circuit section 11, a series resonance is caused between the inductor 16 and the panel capacitor 14, and the panel capacitor 14 is charged and discharged during one half of the resonance period. Meanwhile, a voltage of about one half the value of the voltage VS, which charges the panel capacitor 14, is applied externally, whereby energy used when charging and discharging the panel capacitor 14 with a single X-electrode pulse (or a single Y-electrode pulse in the Y-side driving circuit section 12) is recovered at the recovery capacitor 29 so as to be used when charging the panel capacitor 14 with the next X-electrode pulse. This reduces power required to be newly supplied from the source line VS.

FIG. 2 is a pulse waveform chart describing operation of the driving circuit 10. A waveform A is of the X electrode pulse at the X-side of the panel capacitor 14. A waveform B is of the Y electrode pulse at the Y-side of the panel capacitor 14. A waveform C is a resultant waveform produced from the waveform A and the waveform B to facilitate the understanding of the operation between the surface discharging electrodes. Time Tf is the pulse fall time, and time Tr is the pulse rise time.

In the above prior art plasma display panel driving circuit 10, both the X electrodes and Y electrodes of the plasma display panel require independent circuits: the driving circuit section 11 and the driving circuit section 12. Besides, as the number of driving electrodes increases with increasing panel size, the number of necessary circuits is also increased thus increasing the total number of devices involved. Hence the power consumption and the required circuit space of the prior art PDP driving circuit are quite considerable.

SUMMARY OF INVENTION

It is therefore a primary objective of the invention to provide a driving circuit for a plasma display panel in order to solve the above-mentioned problems.

Briefly described, the invention discloses a driving circuit of a plasma display panel comprising a panel capacitor having an X-side and a Y-side, a voltage clamping circuit, and a energy recovery unit. The voltage clamping circuit comprises a first switch having a first end coupled to a first voltage source and a second end coupled to the X-side of the panel capacitor, a second switch having a first end coupled to a second voltage source and a second end coupled to the X-side of the panel capacitor, a third switch having a first end coupled to a third voltage source and a second end coupled to the Y-side of the panel capacitor, and a fourth switch having a first end coupled to a fourth voltage source and a second end coupled to the Y-side of the panel capacitor. The energy recovery unit is coupled between the X-side of the panel capacitor and the Y-side of the panel capacitor and comprises a fifth switch having a first end coupled to the X-side of the panel capacitor and a second end coupled to the variable voltage source, a sixth switch having a first end coupled to the second end of the fifth switch and a second end, a seventh switch having a first end coupled to the Y-side of the panel capacitor and a second end coupled to the second end of the fifth switch, a first diode having an anode coupled to the X-side of the panel capacitor and a cathode coupled to the second end of the sixth switch, and a second diode having an anode coupled to the Y-side of the panel capacitor and a cathode coupled to the second end of the sixth switch, wherein the fifth switch provides an energy-forward current path for the X-side of the panel capacitor, the sixth switch and the first diode provide an energy-backward current path for the X-side of the panel capacitor, the seventh switch provides an energy-forward current path for the Y-side of the panel capacitor, and the sixth switch and the second diode provide an energy-backward current path for the Y-side of the panel capacitor.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
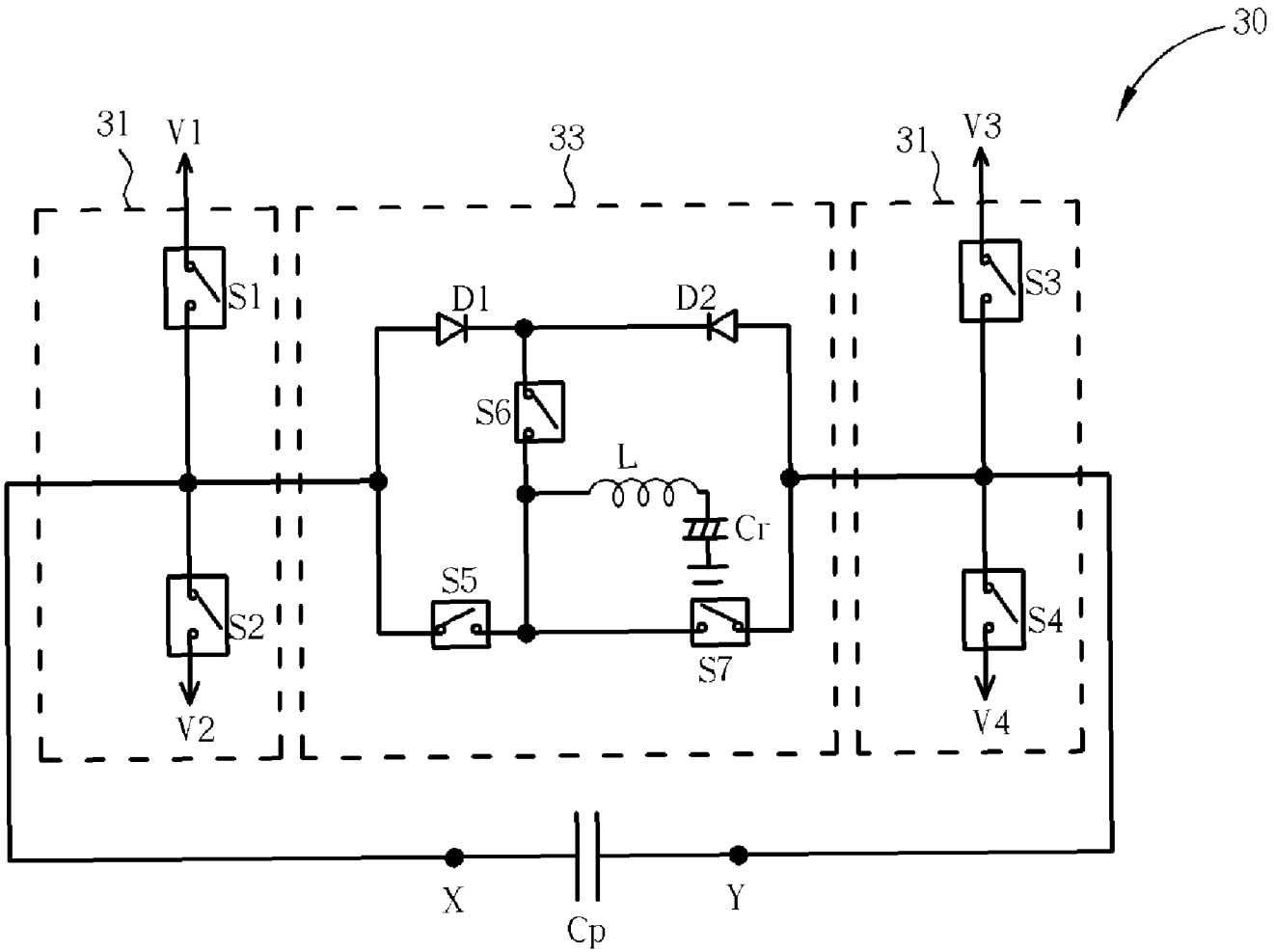
FIG. 3 is a diagram of a PDP driving circuit according to a first embodiment of the present invention.

Please refer to FIG. 3 for a driving circuit 30 of a plasma display panel according to a first embodiment of the present invention. The driving circuit 30 comprises a panel capacitor Cp having an X-side and a Y-side, a voltage clamping circuit 31 and an energy recovery unit 33. The voltage clamp circuit 31 is provided in parallel with the panel capacitor Cp and includes four switches S1 through S4. Each of the switches S1-S4 has one terminal coupled to voltage sources V1-V4 respectively. Another terminal of each of the switches S1 and S2 is coupled to the X-side of the panel capacitor Cp, and another terminal of each of the switches S3 and S4 is coupled to the Y-side of the panel capacitor Cp. Each of the switches S1 through S4 can be an N-type metal oxide semiconductor (NMOS) transistor with a body diode, in which the switch is for passing current from a drain to a source when a high voltage is provided to a gate, and for passing current through the body diode in a direction opposite the direction from the drain to the source when a voltage potential at the source is greater than a voltage potential at the drain. Other devices, such as insulated-gate bipolar transistors (IGBTs), can also be used for switches S1 through S4 as long as they serve the same purpose. The voltage sources V1 and V3 can have the same or different positive voltage potentials, and the voltage sources V2, V4 can have the same or different negative voltage potentials, or can be coupled to ground.

The energy recovery unit 33 is coupled between the X-side and the Y-side of the panel capacitor Cp and comprises a recovery capacitor Cr, an inductor L, switches S5-S7, and diodes D1 and D2. Each of the switches S5 through S7 has a terminal coupled to the recovery capacitor Cr through the inductor L. The switches S5 and S7 serve as unidirectional switches for charging the X-side and the Y-side of the panel capacitor Cp from the recovery capacitor Cr, respectively. The switch S6 serves as a switch for discharging the X-side and the Y-side of the panel capacitor Cp to the recovery capacitor Cr. Each of the switches S5 through S7 can be an IGBT, or other device serving the same purpose. Designated as D1 and D2 are diodes used for respective reverse current blocking.

In the driving circuit 30 of the present invention, a series resonance is caused between the inductor L and the panel capacitor Cp for charging and discharging the X-side and the Y-side of the panel capacitor. The driving circuit 30 includes an X-side energy-forward channel "XEF" comprising the inductor L and the switch S5; an X-side energy-backward channel "XEB" comprising the switch S6, the diode D1, and the inductor L; a Y-side energy-forward channel "YEF" comprising the inductor L and the switch S7; and a Y-side energy-backward channel "YEB" comprising the switch S6, the diode D2, and the inductor L. When charging the X-side of the panel capacitor Cp, the switch S5 is turned on for passing the energy-forward current from the recovery capacitor Cr to the X-side of the panel capacitor Cp through the inductor L and the switch S5; when discharging the X-side of the panel capacitor Cp, the switch S6 is turned on for passing the energy-backward current from the X-side of the panel capacitor Cp to the recovery capacitor Cr through the switch S6, the diode D1 and the inductor L. Similarly, when charging the Y-side of the panel capacitor Cp, the switch S7 is turned on for passing the energy-forward current from the recovery capacitor Cr to the Y-side of the panel capacitor Cp through the switch S7 and the inductor L; when discharging the Y-side of the panel capacitor Cp, the switch S6 is turned on for passing the energy-backward current from the Y-side of the panel capacitor Cp to the recovery capacitor Cr through the inductor L, the switch S6 and the diode D2. Thus, the paths of the "XEF", "XEB", "YEF" and "YEB" channels are as follows:

XEF: Cr→L→S5→Cp

XEB: Cp→D1→S6→L→Cr

YEF: Cr→L→S7→Cp

YEB: Cp→D2→S6→L→Cr

Figure 1:
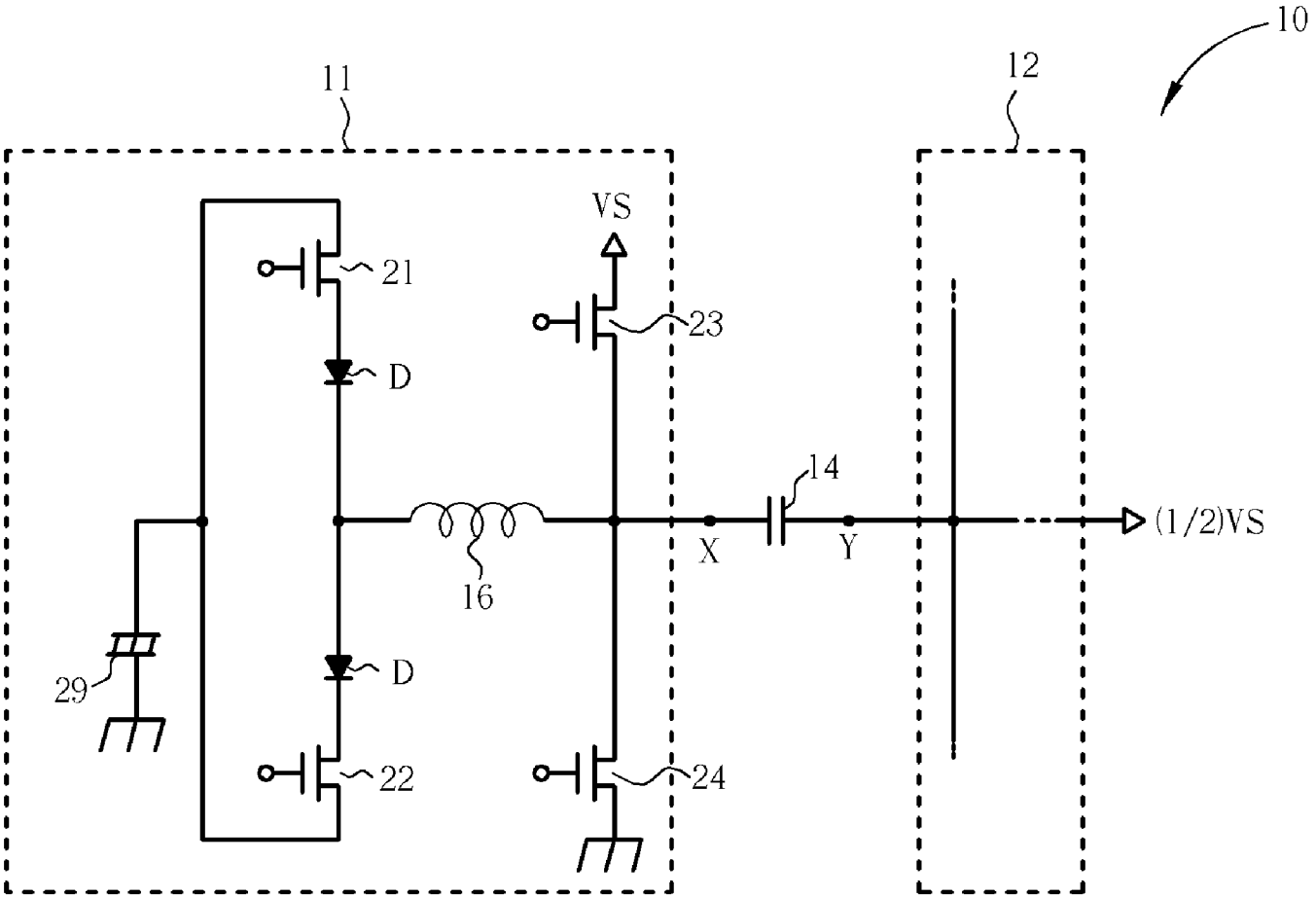
Fig. 1 Prior Art
FIG. 1 is a diagram of a prior art PDP driving circuit.
Figure 2:
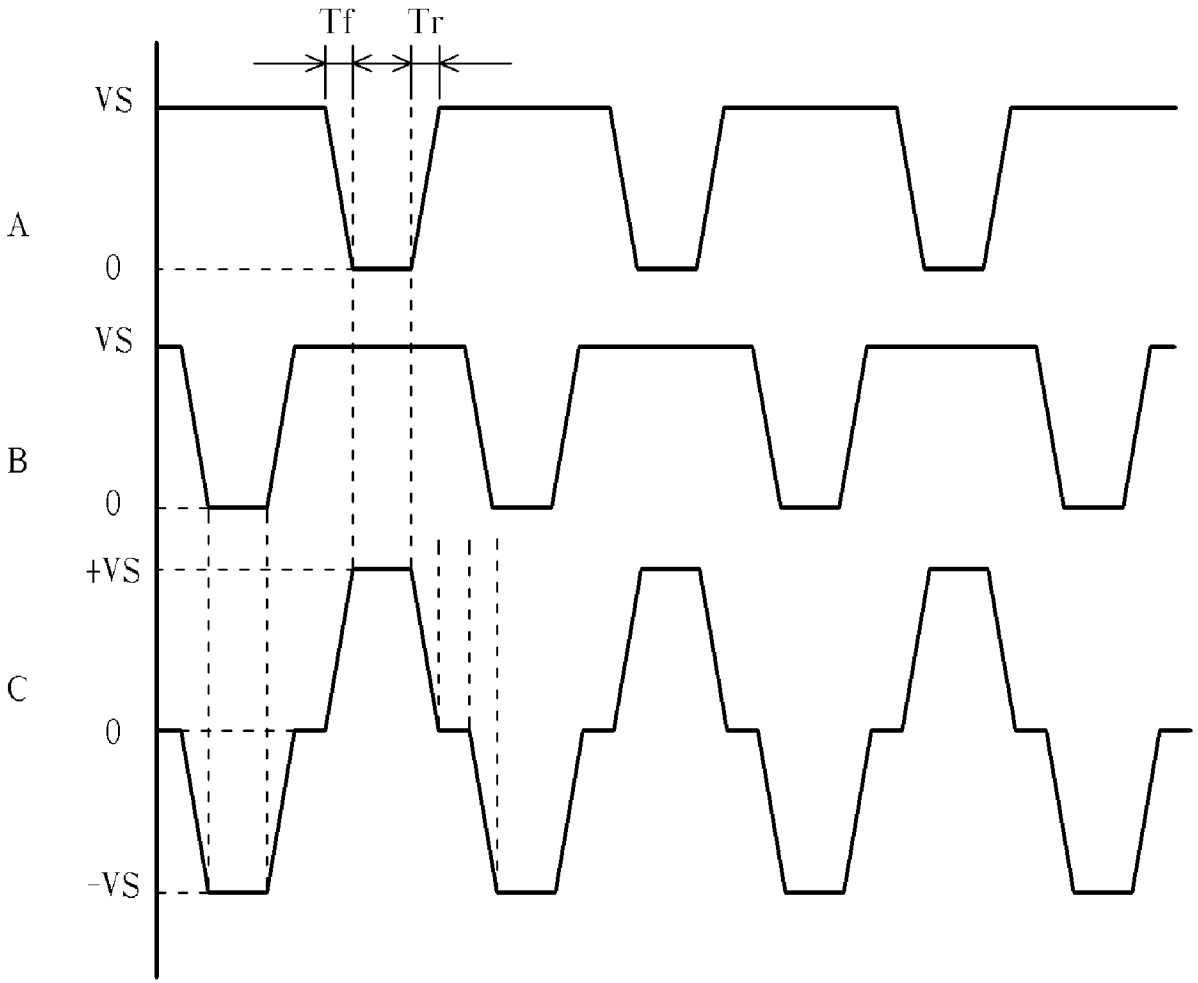
Fig. 2 Prior Art
FIG. 2 is a pulse waveform chart describing operation of the driving circuit of FIG. 1.
Figure 4:
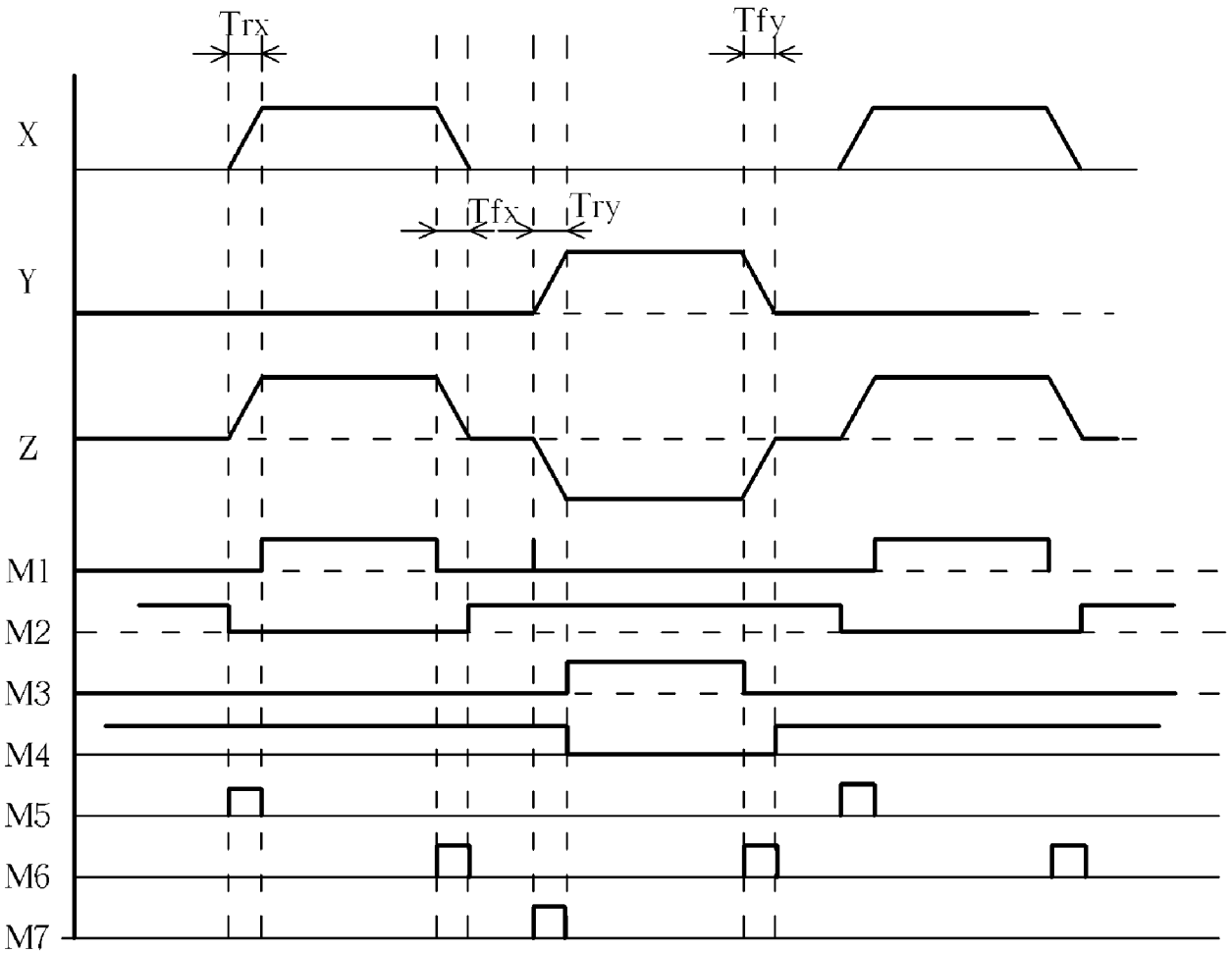
FIG. 4 is a pulse waveform chart describing operation of a PDP driving circuit according to the present invention.

FIG. 4 is a pulse waveform chart describing operation of the driving circuit 30 of the present invention. A waveform X is of the X electrode pulse at the X-side of the panel capacitor Cp. A waveform Y is of the Y electrode pulse at the Y-side of the panel capacitor Cp. A waveform Z is a resultant waveform produced from the waveform X and the waveform Y. Waveforms M1 through M7 are the corresponding states of the switches S1 through S7 during each operational stage of the driving circuit 30 (high level means the switch is on and low level means the switch is off). A rise time Trx and a fall time Tfx of the waveform X and a rise time Try and a fall time Tfy of the waveform Y are determined by the value of the inductor L. Unlike the prior art driving method described in FIG. 2 in which two energy recovery units are required, namely the X-side driving circuit section 11 and the Y-side driving circuit section 12, the present driving method described in FIG. 4 can achieve the same purpose with the driving circuit 30 which utilizes only one energy recovery unit 33.

Figure 5:
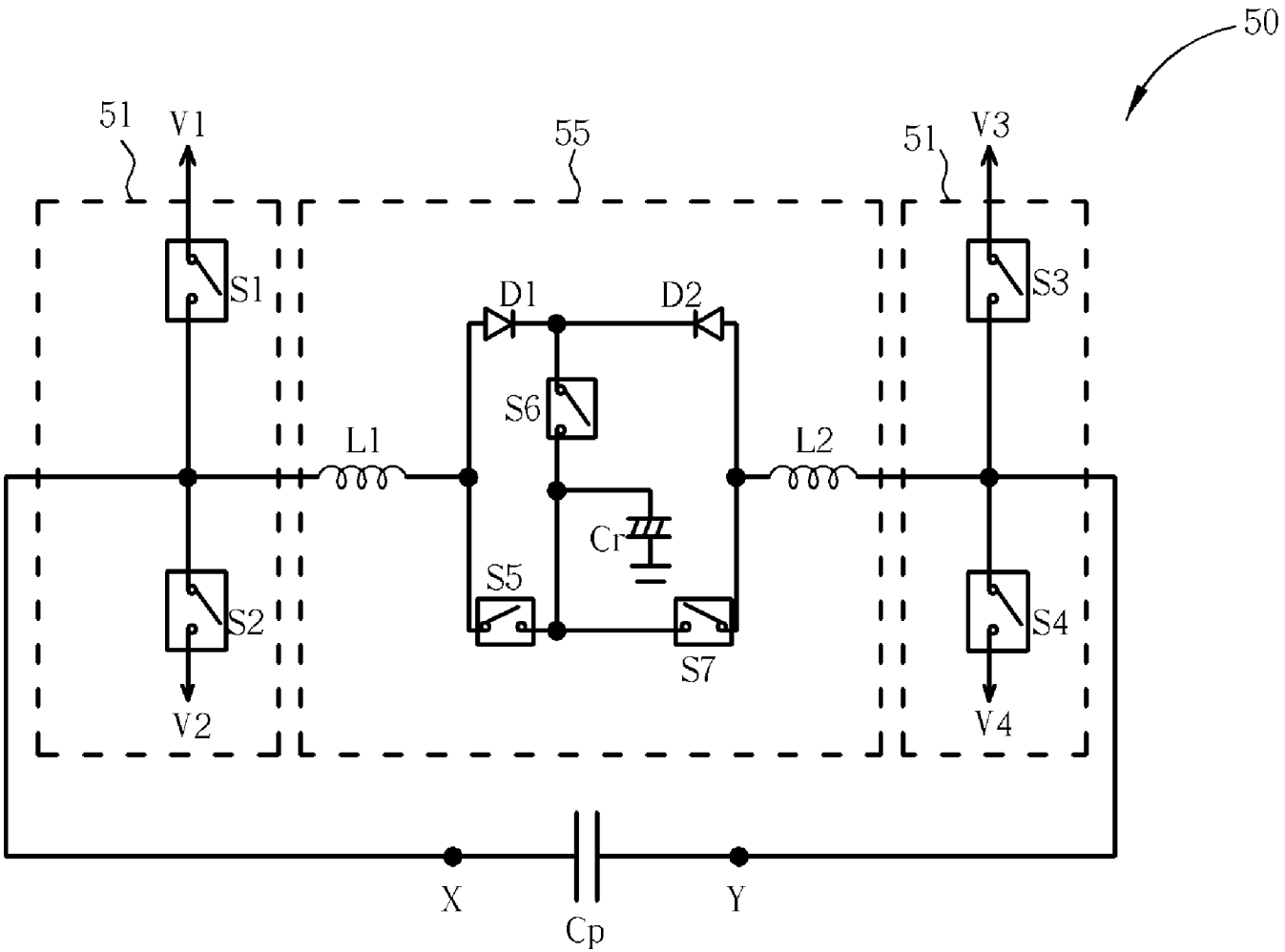
FIG. 5 is a diagram of a PDP driving circuit according to a second embodiment of the present invention.

Please refer to FIG. 5 for a driving circuit 50 of a plasma display panel according to a second embodiment of the present invention. The driving circuit 50 comprises a panel capacitor Cp having an X-side and a Y-side, a voltage clamping circuit 51, and an energy recovery unit 55. The voltage clamp circuit 51 has the same structure as the voltage clamp circuit 31. The driving circuit 50 differs from the driving circuit 30 in that the energy recovery unit 55 comprises two inductors L1 and L2 coupled to the X-side and the Y-side of the panel capacitor Cp respectively. The inductor L1 and the recovery capacitor Cr provide resonant current for charging and discharging the X-side of the panel capacitor Cp, and the inductor L2 and the recovery capacitor Cr provide resonant current for charging and discharging the Y-side of the panel capacitor Cp. The paths of the "XEF", "XEB", "YEF" and "YEB" channels in the driving circuit 50 are as follows:

XEF: Cr→S5→L1→Cp
XEB: Cp→L1→D1→S6→Cr
YEF: Cr→S7→L2→Cp
YEB: Cp→L2→D2→S6→Cr

Panel driving with the driving circuit 50 results in a pulse waveform chart similar to that shown in FIG. 4, with the rise and fall times Trx and Tfx of the waveform X determined by the value of the inductor L1 and the rise and fall times Try and Tfy of the waveform Y determined by the value of the inductor L2. Unlike the prior art driving method described in FIG. 2 in which two energy recovery units are required, the driving circuit 50 can achieve the same purpose with only one energy recovery unit 55.

Figure 6:
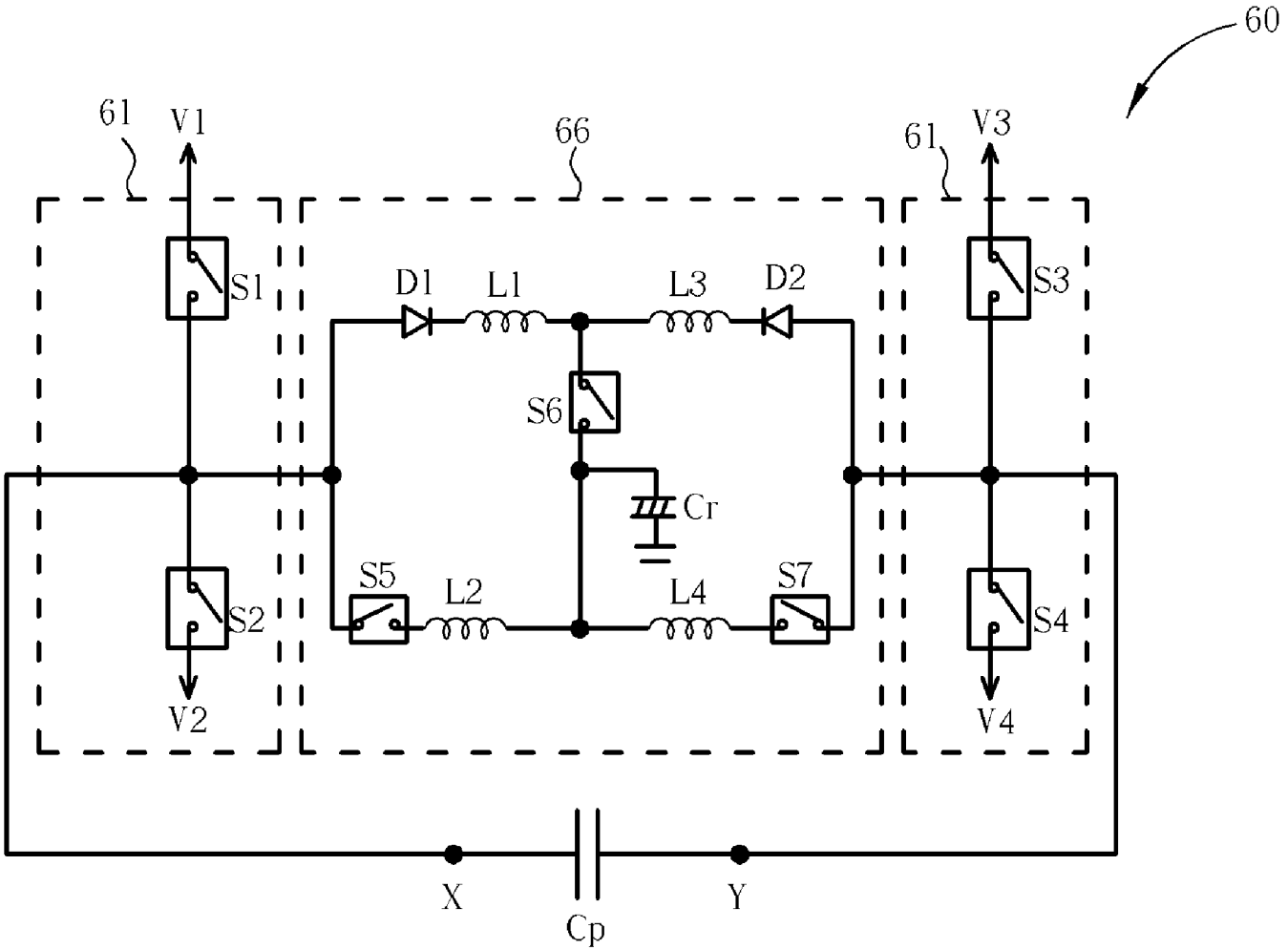
FIG. 6 is a diagram of a PDP driving circuit according to a third embodiment of the present invention.

Please refer to FIG. 6 for a driving circuit 60 of a plasma display panel according to a third embodiment of the present invention. The driving circuit 60 comprises a panel capacitor Cp having an X-side and a Y-side, a voltage clamping circuit 61, and an energy recovery unit 66. The voltage clamp circuit 61 has the same structure as the voltage clamp circuit 31. The driving circuit 60 differs from the driving circuit 30 in that the energy recovery unit 66 comprises four inductors L1 through L4. The inductor L1 is coupled between the switch S6 and the diode D1, the inductor L2 is coupled between the switch S5 and the recovery capacitor Cr, the inductor L3 is coupled between the switch S6 and the diode D2, and the inductor L4 is coupled between the switch S7 and the recovery capacitor Cr. The inductor L2 and the recovery capacitor Cr provide resonant current for charging the X-side of the panel capacitor Cp and the inductor L1 and the recovery capacitor Cr provide resonant current for discharging the X-side of the panel capacitor Cp. Similarly, the inductor L4 and the recovery capacitor Cr provide resonant current for charging the Y-side of the panel capacitor Cp and the inductor L3 and the recovery capacitor Cr provide resonant current for discharging the Y-side of the panel capacitor Cp. The paths of the "XEF", "XEB", "YEF" and "YEB" channels in the driving circuit 60 are as follows:

XEF: Cr→L2→S5→Cp
XEB: Cp→D1→L1→S6→Cr
YEF: Cr→L4→S7→Cp
YEB: Cp→D2→L3→S6→Cr

Panel driving with the driving circuit 60 results in a pulse waveform chart similar to that shown in FIG. 4, with the rise and fall times Trx, Tfx, Try and Tfy of the waveforms X and Y determined by the value of the inductor L2, L1, L4 and L3, respectively. Unlike the prior art driving method described in FIG. 2 in which two energy recovery units are required, the driving circuit 60 can achieve the same purpose with only one energy recovery unit 66.

Figure 7:
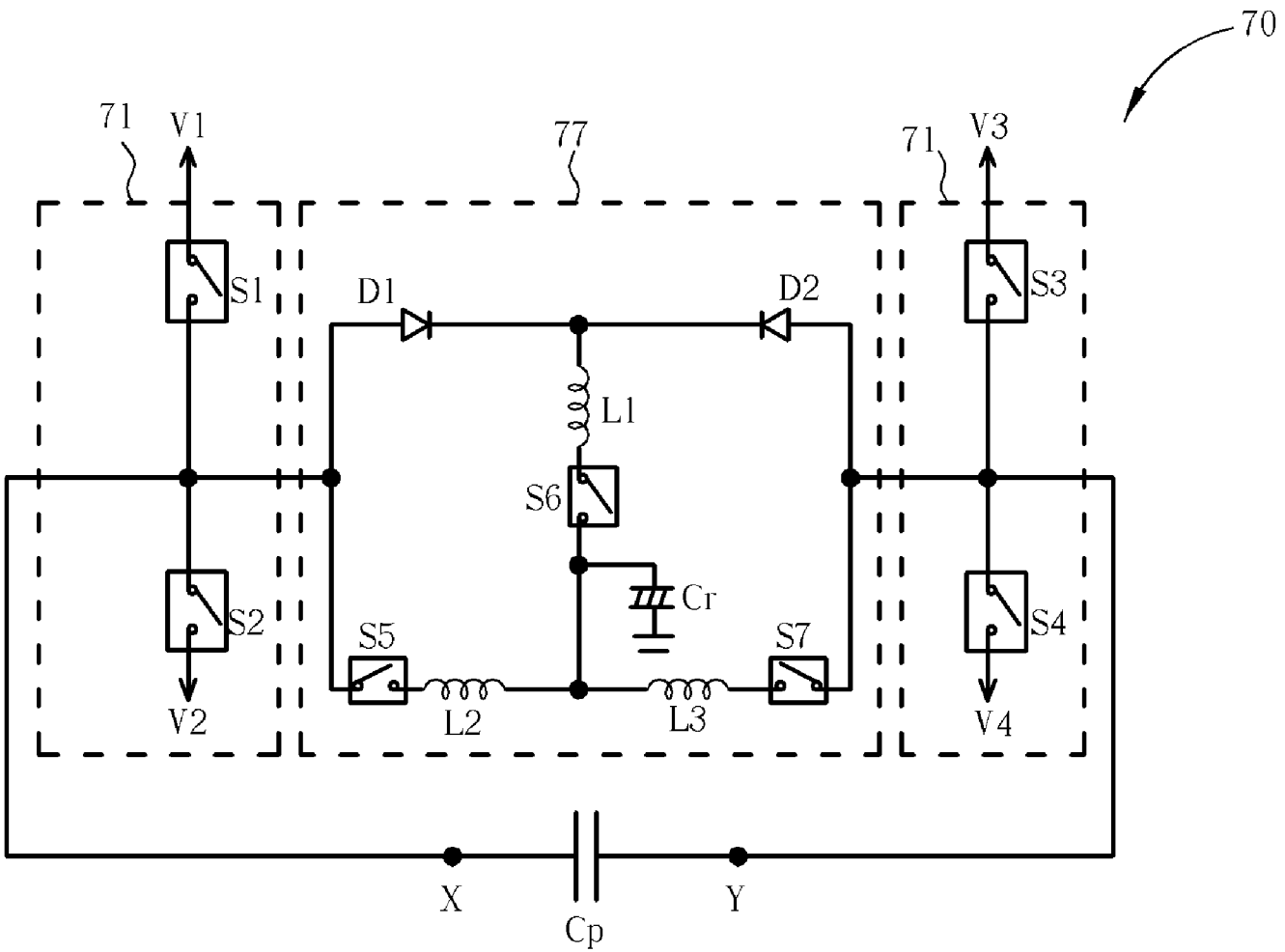
FIG. 7 is a diagram of a PDP driving circuit according to a fourth embodiment of the present invention.

Please refer to FIG. 7 for a driving circuit 70 of a plasma display panel according to a fourth embodiment of the present invention. The driving circuit 70 comprises a panel capacitor Cp having an X-side and a Y-side, a voltage clamping circuit 71, and an energy recovery unit 77. The voltage clamp circuit 71 has the same structure as the voltage clamp circuit 31. The driving circuit 70 differs from the driving circuit 30 in that the energy recovery unit 77 comprises three inductors L1 through L3. The inductor L1 has a first end coupled to the switch S6 and a second end coupled between the diodes D1 and D2. The inductor L2 is coupled between the switch S5 and the recovery capacitor Cr, and the inductor L3 is coupled between the switch S7 and the recovery capacitor Cr. The inductor L2 and the recovery capacitor Cr provide resonant current for charging the X-side of the panel capacitor Cp and the inductor L1 and the recovery capacitor Cr provide resonant current for discharging the X-side of the panel capacitor Cp. Similarly, the inductor L3 and the recovery capacitor Cr provide resonant current for charging the Y-side of the panel capacitor Cp and the inductor L1 and the recovery capacitor Cr provide resonant current for discharging the Y-side of the panel capacitor Cp. The paths of the "XEF", "XEB", "YEF" and "YEB" channels in the driving circuit 70 are as follows:

XEF: Cr→L2→S5→Cp
XEB: Cp→D1→L1→S6→Cr
YEF: Cr→L3→S7→Cp
YEB: Cp→D2→L1→S6→Cr

Panel driving with the driving circuit 70 results in a pulse waveform chart similar to that shown in FIG. 4, with the rise and fall times Trx, Tfx, Try and Tfy of the waveforms X and Y determined by the value of the inductor L2, L1, L3 and L1, respectively. Unlike the prior art driving method described in FIG. 2 in which two energy recovery units are required, the driving circuit 70 can achieve the same purpose with only one energy recovery unit 77.

Figure 8:
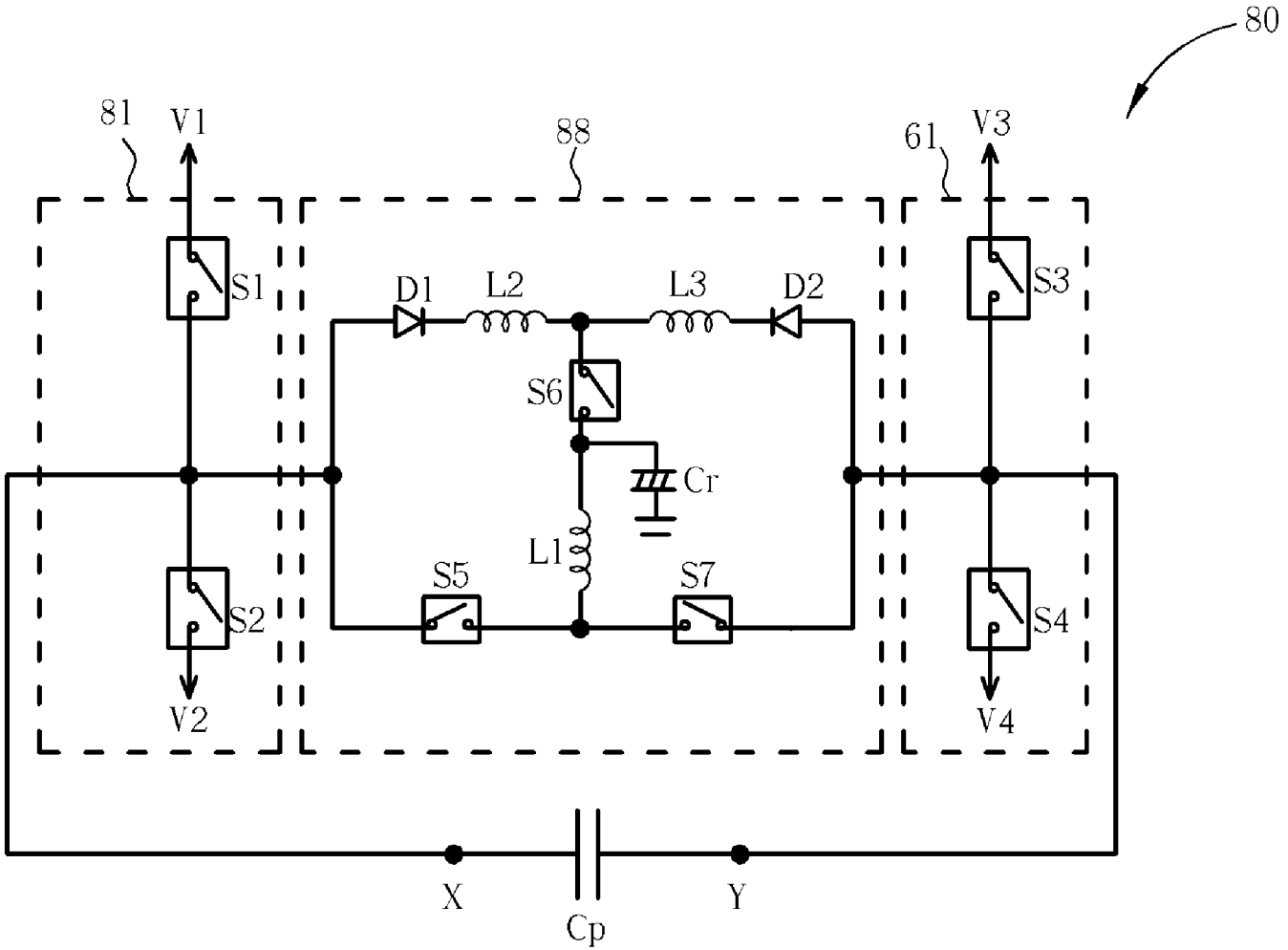
FIG. 8 is a diagram of a PDP driving circuit according to a fifth embodiment of the present invention.

Please refer to FIG. 8 for a driving circuit 80 of a plasma display panel according to a fifth embodiment of the present invention. The driving circuit 80 comprises a panel capacitor Cp having an X-side and a Y-side, a voltage clamping circuit 81, and an energy recovery unit 88. The voltage clamp circuit 81 has the same structure as the voltage clamp circuit 31. The driving circuit 80 differs from the driving circuit 30 in that the energy recovery unit 88 comprises three inductors L1 through L3. The inductor L1 has a first end coupled to the recovery capacitor Cr and a second end coupled between the switches S5 and S7. The inductor L2 is coupled between the switch S6 and the diode D1, and the inductor L3 is coupled between the switch S6 and the diode D2. The inductor L1 and the recovery capacitor Cr provide resonant current for charging the X-side of the panel capacitor Cp and the inductor L2 and the recovery capacitor Cr provide resonant current for discharging the X-side of the panel capacitor Cp. Similarly, the inductor L1 and the recovery capacitor Cr provide resonant current for charging the Y-side of the panel capacitor Cp and the inductor L3 and the recovery capacitor Cr provide resonant current for discharging the Y-side of the panel capacitor Cp. The paths of the "XEF", "XEB", "YEF" and "YEB" channels in the driving circuit 70 are as follows:

XEF: Cr→L1→S5→Cp
XEB: Cp→D1→L2→S6→Cr
YEF: Cr→L1→S7→Cp
YEB: Cp→D2→L3→S6→Cr

Panel driving with the driving circuit 80 results in a pulse waveform chart similar to that shown in FIG. 4, with the rise and fall times Trx, Tfx, Try and Tfy of the waveforms X and Y determined by the value of the inductor L1, L2, L1 and L3, respectively. Unlike the prior art driving method described in FIG. 2 in which two energy recovery units are required, the driving circuit 80 can achieve the same purpose with only one energy recovery unit 88.

Figure 9:
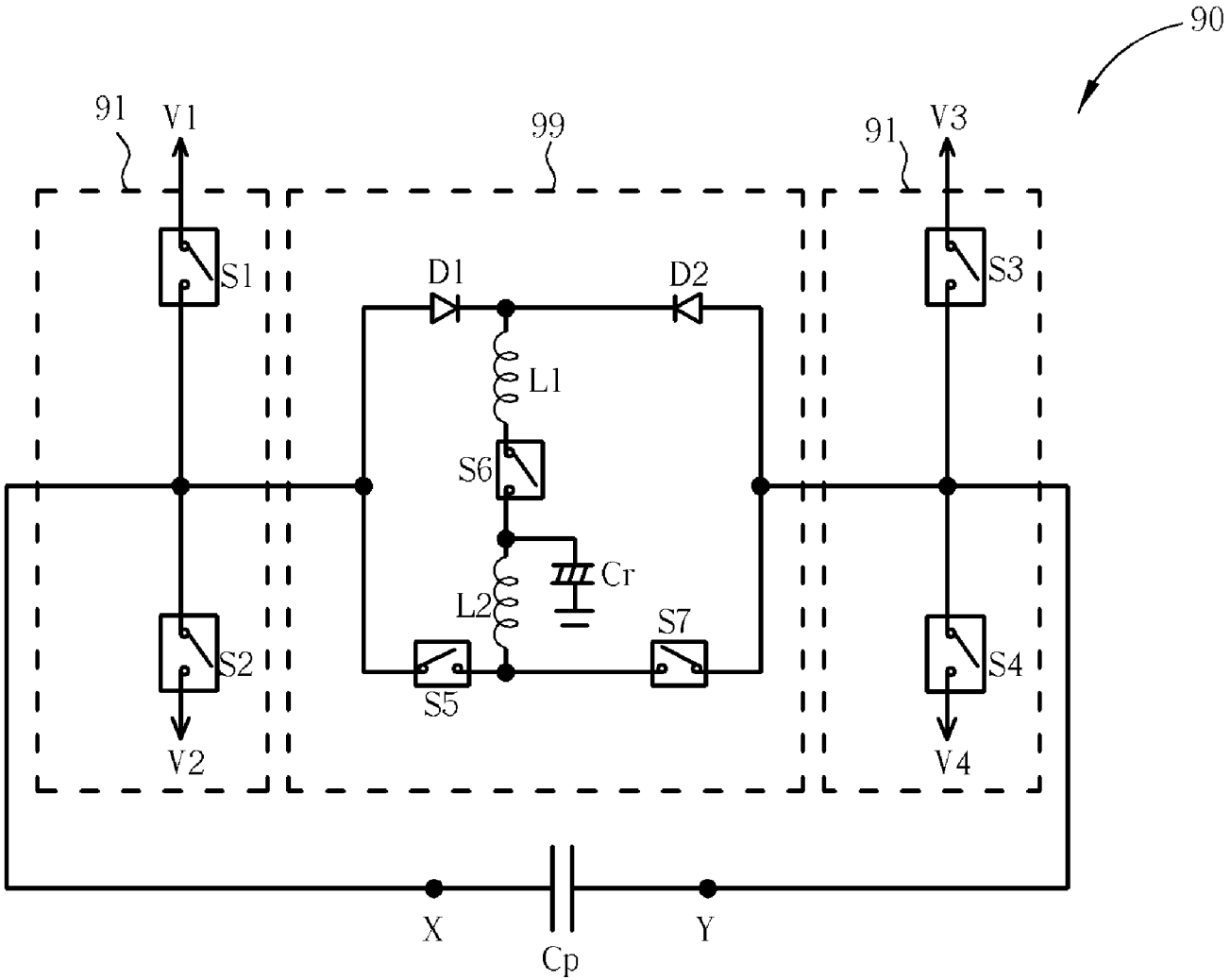
FIG. 9 is a diagram of a PDP driving circuit according to a sixth embodiment of the present invention.

Please refer to FIG. 9 for a driving circuit 90 of a plasma display panel according to a sixth embodiment of the present invention. The driving circuit 90 comprises a panel capacitor Cp having an X-side and a Y-side, a voltage clamping circuit 91, and an energy recovery unit 99. The voltage clamp circuit 91 has the same structure as the voltage clamp circuit 31. The driving circuit 90 differs from the driving circuit 30 in that the energy recovery unit 99 comprises two inductors L1 and L2. The inductor L1 has a first end coupled to the sixth switch and a second end coupled between the diodes D1 and D2. The inductor L2 has a first end coupled to the recovery capacitor Cr and a second end coupled between the switches S5 and S7. The inductor L2 and the recovery capacitor Cr provide resonant current for charging the X-side and the Y-side of the panel capacitor Cp. The inductor L1 and the recovery capacitor Cr provide resonant current for discharging the X-side and the Y-side of the panel capacitor Cp. The paths of the "XEF", "XEB", "YEF" and "YEB" channels in the driving circuit 90 are as follows:

XEF: Cr→L2→S5→Cp

XEB: Cp→D1→L1→S6→Cr

YEF: Cr→L2→S7→Cp

YEB: Cp→D2→L1→S6→Cr

Panel driving with the driving circuit 90 results in a pulse waveform chart similar to that shown in FIG. 4, with the rise times Trx and Try of the waveform X and waveform Y determined by the value of the inductor L2 and the fall times Tfx and Tfy of the waveform X and waveform Y determined by the value of the inductor L1. Unlike the prior art driving method described in FIG. 2 in which two energy recovery units are required, the driving circuit 90 can achieve the same purpose with only one energy recovery unit 99.

In the prior art driving circuit 10, both the X electrodes and the Y electrodes of the plasma display panel require independent driving circuits. Therefore more devices are required and more circuit space is needed in such driving circuit designs. The number of driving electrodes and the power consumption also increases as the panel size increases. Compared to the prior art, the present invention driving circuits 30, 50-90 can achieve the same driving effect for a plasma display panel as the prior art driving circuit 10 with simpler circuit structure and fewer required devices. By using only one recovery circuit for both sides of the panel capacitor, the present invention can be realized with a reduced number of devices and reduce unnecessary or ineffective power consumption for the plasma display panel driving circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit of a plasma display panel comprising:

a panel capacitor having an X-side and a Y-side;

a voltage clamping circuit comprising:

a first switch having a first end coupled to a first voltage source and a second end coupled to the X-side of the panel capacitor;

a second switch having a first end coupled to a second voltage source and a second end coupled to the X-side of the panel capacitor;

a third switch having a first end coupled to a third voltage source and a second end coupled to the Y-side of the panel capacitor;

a fourth switch having a first end coupled to a fourth voltage source and a second end coupled to the Y-side of the panel capacitor; and an energy recovery unit coupled between the X-side of the panel capacitor and the Y-side of the panel capacitor for charging and discharging the panel capacitor, the energy recovery unit comprising:

a variable voltage source;

a fifth switch having a first end coupled to the X-side of the panel capacitor and a second end coupled to the variable voltage source;

a sixth switch having a first end coupled to the second end of the fifth switch and a second end;

a seventh switch having a first end coupled to the Y-side of the panel capacitor and a second end coupled to the second end of the fifth switch;

a first diode having an anode coupled to the X-side of the panel capacitor and a cathode coupled to the second end of the sixth switch; and a second diode having an anode coupled to the Y-side of the panel capacitor and a cathode coupled to the second end of the sixth switch;

wherein the fifth switch provides an energy-forward current path for the X-side of the panel capacitor, the sixth switch and the first diode provide an energy-backward current path for the X-side of the panel capacitor, the seventh switch provides an energy-forward current path for the Y-side of the panel capacitor, and the sixth switch and the second diode provide an energy-backward current path for the Y-side of the panel capacitor.

2. The driving circuit of claim 1 wherein the energy recovery unit further comprises:

an inductor coupled between the first end of the sixth switch and the variable voltage source;

wherein the inductor and the fifth switch provide an energy-forward current path for the X-side of the panel capacitor, the inductor, the sixth switch and the first diode provide an energy-backward current path for the X-side of the panel capacitor, the inductor and the seventh switch provides an energy-forward current path for the Y-side of the panel capacitor, and the inductor and the sixth switch and the second diode provide an energy-backward current path for the Y-side of the panel capacitor.

3. The driving circuit of claim 1 wherein the energy recovery unit further comprises:

a first inductor coupled between the first end of the fifth switch and the X-side of the panel capacitor;

a second inductor coupled between the first end of the seventh switch and the Y-side of the panel capacitor;

wherein the first inductor and the fifth switch provide an energy-forward current path for the X-side of the panel capacitor, the first inductor, the sixth switch and the first diode provide an energy-backward current path for the X-side of the panel capacitor, the second inductor and the seventh switch provide an energy-forward current path for the Y-side of the panel capacitor, and the second inductor, the sixth switch and the second diode provide an energy-backward current path for the Y-side of the panel capacitor.

4. The driving circuit of claim 3 wherein the first and second inductors have different inductances.

5. The driving circuit of claim 3 wherein the inductances of the first and second inductors are the same.

6. The driving circuit of claim 1 wherein the energy recovery unit further comprises:

a first inductor coupled between the cathode of the first diode and the second end of the sixth switch;

a second inductor coupled between the second end of the fifth switch and the first end of the sixth switch;

a third inductor coupled between the cathode of the second diode and the second end of the sixth switch;

a fourth inductor coupled between the second end of the seventh switch and the first end of the sixth switch;

wherein the second inductor and the fifth switch provide an energy-forward current path for the X-side of the panel capacitor, the first inductor, the sixth switch and the first diode provide an energy-backward current path for the X-side of the panel capacitor, the fourth inductor and the seventh switch provide an energy-forward current path for the Y-side of the panel capacitor, and the third inductor, the sixth switch and the second diode provide an energy-backward current path for the Y-side of the panel capacitor.

7. The driving circuit of claim 6 wherein the first, second, third and fourth inductors have different inductances.

8. The driving circuit of claim 6 wherein the inductances of the first, second, third and fourth inductors are the same.

9. The driving circuit of claim 1 wherein the energy recovery unit further comprises:

a first inductor having a first end coupled to the second end of the sixth switch and a second end coupled between the cathodes of the first and second diodes;

a second inductor coupled between the second end of the fifth switch and the first end of the sixth switch; and a third inductor coupled between the second end of the seventh switch and the first end of the sixth switch;

wherein the second inductor and the fifth switch provide an energy-forward current path for the X-side of the panel capacitor, the first inductor, the sixth switch and the first diode provide an energy-backward current path for the X-side of the panel capacitor, the third inductor and the seventh switch provide an energy-forward current path for the Y-side of the panel capacitor, and the first inductor, the sixth switch and the second diode provide an energy-backward current path for the Y-side of the panel capacitor.

10. The driving circuit of claim 9 wherein the first, second and third inductors have different inductances.

11. The driving circuit of claim 9 wherein the inductances of the first, second and third inductors are the same.

12. The driving circuit of claim 1 wherein the energy recovery unit further comprises:

a first inductor having a first end coupled to the first end of the sixth switch and a second end coupled between the second ends of the fifth and seventh switches;

a second inductor coupled between the second end of the sixth switch and the cathode of the first diode; and a third inductor coupled between the second end of the sixth switch and the cathode of the second diode;

wherein the first inductor and the fifth switch provide an energy-forward current path for the X-side of the panel capacitor, the second inductor, the sixth switch and the first diode provide an energy-backward current path for the X-side of the panel capacitor, the first inductor and the seventh switch provide an energy-forward current path for the Y-side of the panel capacitor, and the third inductor, the sixth switch and the second diode provide an energy-backward current path for the Y-side of the panel capacitor.

13. The driving circuit of claim 12 wherein the first, second and third inductors have different inductances.

14. The driving circuit of claim 12 wherein the inductances of the first, second and third inductors are the same.

15. The driving circuit of claim 1 wherein the energy recovery unit further comprises:

a first inductor having a first end coupled to the second end of the sixth switch and a second end coupled between the cathodes of the first and second diodes; and a second inductor having a first end coupled to the first end of the sixth switch and a second end coupled between the second ends of the fifth and seventh switches;

wherein the second inductor and the fifth switch provide an energy-forward current path for the X-side of the panel capacitor, the first inductor, the sixth switch and the first diode provide an energy-backward current path for the X-side of the panel capacitor, the second inductor and the seventh switch provide an energy-forward current path for the Y-side of the panel capacitor, and the first inductor, the sixth switch and the second diode provide an energy-backward current path for the Y-side of the panel capacitor.

16. The driving circuit of claim 15 wherein the first and second inductors have different inductances.

17. The driving circuit of claim 15 wherein the inductances of the first and second inductors are the same.

18. The driving circuit of claim 1 wherein the voltage potential of the first voltage source equals the voltage potential of the third voltage source.

19. The driving circuit of claim 1 wherein the voltage potential of the first voltage source is different from the voltage potential of the third voltage source.

20. The driving circuit of claim 1 wherein the voltage potential of the second voltage source equals the voltage potential of the fourth voltage source.

21. The driving circuit of claim 1 wherein the voltage potential of the second voltage source is different from the voltage potential of the fourth voltage source.

22. The driving circuit of claim 1 wherein the variable voltage source comprises a capacitor.

23. The driving circuit of claim 1 wherein the variable voltage source has ground voltage.

* * * * *